US005288521A

United States Patent [19]

Maldaner

[11] Patent Number: 5,288,521

[45] Date of Patent: Feb. 22, 1994

[54] PROCESS AND APPARATUS FOR THE IMPREGNATION OF WORKPIECES OF POROUS MATERIAL

[76] Inventor: Hubert Maldaner, Max-Planck-Ring 3, D-4018 Langenfeld/Rhld., Fed. Rep. of Germany

[21] Appl. No.: 840,663

[22] Filed: Feb. 20, 1992

Related U.S. Application Data

[63] Continuation of Ser. No. 597,083, Oct. 15, 1990, abandoned.

[30] Foreign Application Priority Data

Oct. 25, 1989 [EP] European Pat. Off. ..... 89119784.0

[51] Int. Cl.[5] ..... B05D 3/12; B05D 3/04

[52] U.S. Cl. ..... 427/346; 427/348; 427/295; 427/327; 427/435; 427/238

[58] Field of Search ..... 264/69, 71, 102, 257; 425/421, 456; 427/57, 294, 601, 295, 348, 435, 327, 346, 238, 239

[56] References Cited

U.S. PATENT DOCUMENTS

| | | | |
|---|---|---|---|
| 2,311,358 | 2/1943 | Baily | 264/71 |
| 2,442,519 | 6/1948 | Schuetz | 264/71 |
| 2,614,312 | 10/1952 | Rankin et al. | 425/456 |
| 2,909,826 | 10/1959 | McElroy | 425/456 |
| 3,042,594 | 7/1962 | Hauth | 264/69 |
| 3,158,499 | 11/1964 | Jenkin | 427/57 |
| 3,160,519 | 12/1964 | Parisot | 427/294 |
| 3,467,546 | 9/1969 | Page et al. | 427/57 |
| 3,513,016 | 5/1970 | Wood et al. | 427/57 |
| 3,551,190 | 12/1970 | Myers | 427/57 |
| 3,639,152 | 2/1972 | Bodine, Jr. | 427/57 |
| 3,701,676 | 10/1972 | Bader et al. | 427/295 |
| 3,964,527 | 6/1976 | Zwart | 264/69 |
| 3,969,552 | 7/1976 | Malofsky et al. | 427/295 |
| 4,147,821 | 4/1979 | Young | 427/295 |
| 4,311,735 | 1/1982 | Young | 427/295 |
| 4,338,353 | 7/1982 | Melchior | 427/57 |
| 4,416,921 | 11/1983 | Dunn | 427/295 |
| 4,614,436 | 9/1986 | Setterberg | 264/71 |
| 4,681,718 | 7/1987 | Oldham | 264/102 |
| 5,089,288 | 2/1992 | Berger | 427/57 |

FOREIGN PATENT DOCUMENTS

| | | | |
|---|---|---|---|
| 1443696 | 7/1976 | United Kingdom | 264/71 |

*Primary Examiner*—Shrive Beck
*Assistant Examiner*—Diana Dudash
*Attorney, Agent, or Firm*—Merchant, Gould, Smith, Edell, Welter & Schmidt

[57] ABSTRACT

A process for the impregnation of workpieces of porous material and an apparatus to carry out the process are disclosed. The impregnation of workpieces is carried out in that, initially, all gas is withdrawn from the workpiece by evacuation, whereupon the workpiece is saturated with impregnating agent. Impregnation can be carried out in a very short period of time, if the workpieces are subjected to vibration during impregnation.

8 Claims, 2 Drawing Sheets

PROCESS AND APPARATUS FOR THE IMPREGNATION OF WORKPIECES OF POROUS MATERIAL

This is a continuation of application Ser. No. 07/597,083, filed Oct. 15, 1990, which was abandoned upon the filing hereof.

The invention relates to a process for the impregnation of workpieces of porous material, whereby the workpiece is placed in a closed chamber, such as an autoclave, and this autoclave is then evacuated, and whereby an impregnating agent is fed into the autoclave after the evacuation. In addition, the invention relates to apparatus for the impregnation of workpieces of porous material comprising a receptacle which can be sealed by means of a lid, and having a discharge means for air, a vacuum pump and a supply line for impregnating agent.

During impregnating, the hollow spaces in a porous solid body are to be filled with impregnating agent. The impregnating agent is a liquid. The penetration of the pores, in as much as they are outwardly open, is substantially brought about by capillary action. It is carried out fully only when all gases have previously been removed from the solid body and from the impregnating liquid by evacuation.

The impregnating process is widely used. For example, timbers such as poles for overhead lines and pit props are impregnated with aqueous saline solutions or creosotes to protect them from rotting and against vermin.

By far the greatest use of the impregnating process is, however, made in the electrical industry. It is also in this connection, that the greatest demands are made, since the quality of the dielectric thus produced depends on the impregnation. Thus, for example, capacitors, transformers and high-voltage cables are impregnated.

In recent years, metal impregnation has assumed considerable importance. As a result of the constantly increasing use of diecast parts in the construction of vehicles as well as in the field of pneumatics and hydraulics, and in the electrical industry, economical production is no longer possible without the impregnation of work pieces. Thus, in many cases, the impregnation of all the parts produced is already programmed during production planning.

Polyacrylates are predominantly used as impregnating agents, since impregnating agents based on polyester resin and phenolic resin are only seldom used, owing to their environmentally unfavourable properties.

The invention can be applied in particular for metal impregnation. For efficient production, it is necessary that the impregnating process is completed speedily.

The object of the invention is to improve the above-described process for the impregnation of workpieces of porous material such that the impregnating process can be completed in less time than heretofore.

In the process according to the invention, the workpieces are subjected to vibration, together with the impregnation receptacle. It was found that the impregnating process could be accelerated considerably as a result hereof, since the impregnating agent then penetrates more rapidly into the pores or interspaces of the workpieces to be impregnated. Surprisingly, after a very short interval, the impregnating agent penetrates into the work pieces so deeply that, as far as quality is concerned, a high-grade impregnation is provided in an economical manner.

The apparatus to carry out the process according to the invention comprises an autoclave or a similar receptacle which can be sealed by means of a lid and which is provided with a discharge means for air as well as with a supply pipe for impregnating agent. The evacuation is carried out with the aid of a vacuum pump. According to the invention, an apparatus of this kind has one or more vibration generators.

In a preferred embodiment, the vibration generator or generators are provided on the outside wall of the receptacle. The vibrations are transmitted to the workpiece by the impregnating agent. This arrangement has the advantage that the vibration generator itself does not come into contact with the impregnating agent and there is, therefore, no danger of soiling or even destruction.

It was found that different workpieces must also be subjected to different frequencies for the impregnation to be carried out in the desired manner. It is, therefore, advantageous if the working frequencies of the vibration generators are variably adjustable.

It is particularly advantageous when the working frequency of the vibration generators is identical to the natural frequency of the entire apparatus. The impregnating process is then carried out particularly rapidly.

The invention will now be described in more detail with reference to the drawing, wherein exemplified embodiments of the apparatus according to the present invention are illustrated in FIGS. 1 and 2.

The impregnation receptacles may be arranged vertically or horizontally. In practice, vertical impregnation receptacles are used for workpieces and charging cages having a height of up to about 2 to 3 meters. Long workpieces, e.g. structural timber, telephone poles and the like, are preferably treated in impregnation receptacles which are arranged horizontally.

The invention can be utilized with success in respect of both systems.

In the case of horizontal receptacles, it is always necessary that the receptacle lid be provided with a lock. In the case of vertical receptacles, a lid lock is required only for pressure receptacles. When the method used is the vacuum-only method, a close-fitting support of the lid on the receptacle seal is sufficient. When there is a vacuum in the receptacle, the lid is pressed by atmospheric pressure on to the seal in the receptacle collar.

All receptacles in which the invention is to be applied must be mounted on rocking elements, such that the vibrations which are produced can be transmitted to the entire receptacle.

Figure 1:
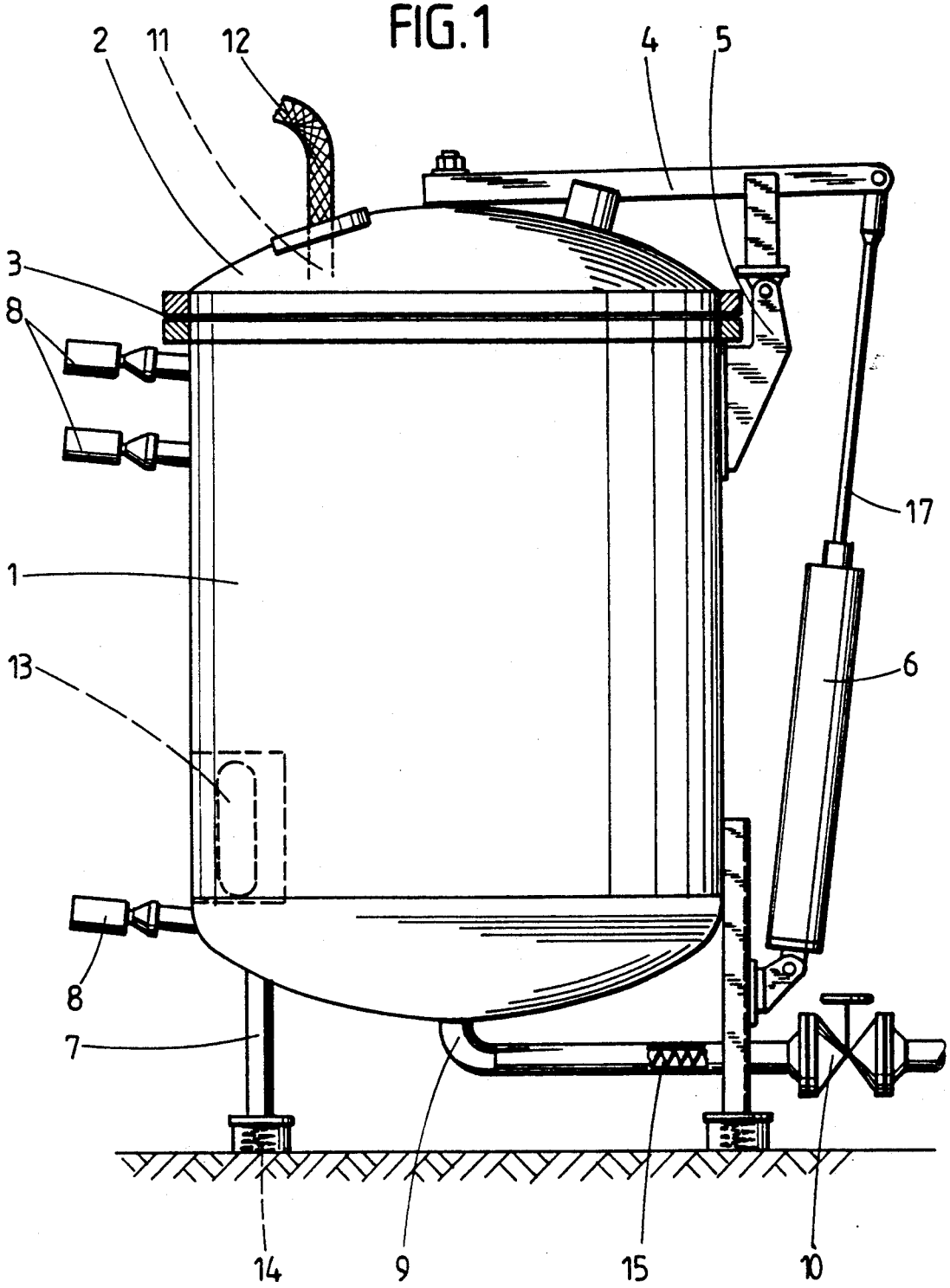
FIG. 1 shows a vertical impregnation receptacle.

FIG. 1 shows a vertical impregnation receptacle. The apparatus comprises an impregnation receptacle (1), which can be sealed tightly by means of a lid (2). A lid seal (3) is placed in position in a groove and serves as sealing means between receptacle (1) and lid (2). In the case of receptacles which operate only under vacuum, a lock for the lid is not required. If, however, vacuum and pressure are alternately used, locking of the lid is necessary. For this purpose, bayonet catches are generally used. It is possible to use eyelet screws, but this is frequently not economical and is, therefore, currently seldom used.

The lid (3) is attached to a lid bracket (4) which is supported for rotation in a lid hinge (5). The lid can be opened and closed by means of a pneumatic cylinder (6) and a telescopic piston rod (17). In small plants, the lid is frequently manually controlled. To facilitate the latter, a counterweight is often provided on the lid bracket (4).

Depending on its dimensions, the receptacle is supported on three or four stands (7).

Three level-control devices (8) are provided laterally in the outer wall of the receptacle, for the regulation and control of the level of the impregnating liquid.

Attached to the bottom of the receptacle (1) is a pipe connection, having a pipeline (9) and a stop valve (10), via which the impregnating liquid is guided into the receptacle and out of the receptacle. Arranged in the lid (2) of the receptacle (1), is a pipe connection (11) which, via a vacuum-tight tube (12), connects the receptacle to the controlling means and to the vacuum pump.

On the side of the receptacle, depending on size, one or more vibration generators (13) is/are attached which subject/s the receptacle, together with its content, to vibrations. These vibration generators can be actuated mechanically or electromagnetically.

The receptacle (1) is mounted on rocking elements (14) in order that the vibrations generated are fully effective.

A spring bellows (15), which ensures a flexible connection to the pipe system, which is not shown, and to the supply tank, which is also not shown, is provided in the pipeline (9).

Figure 2:
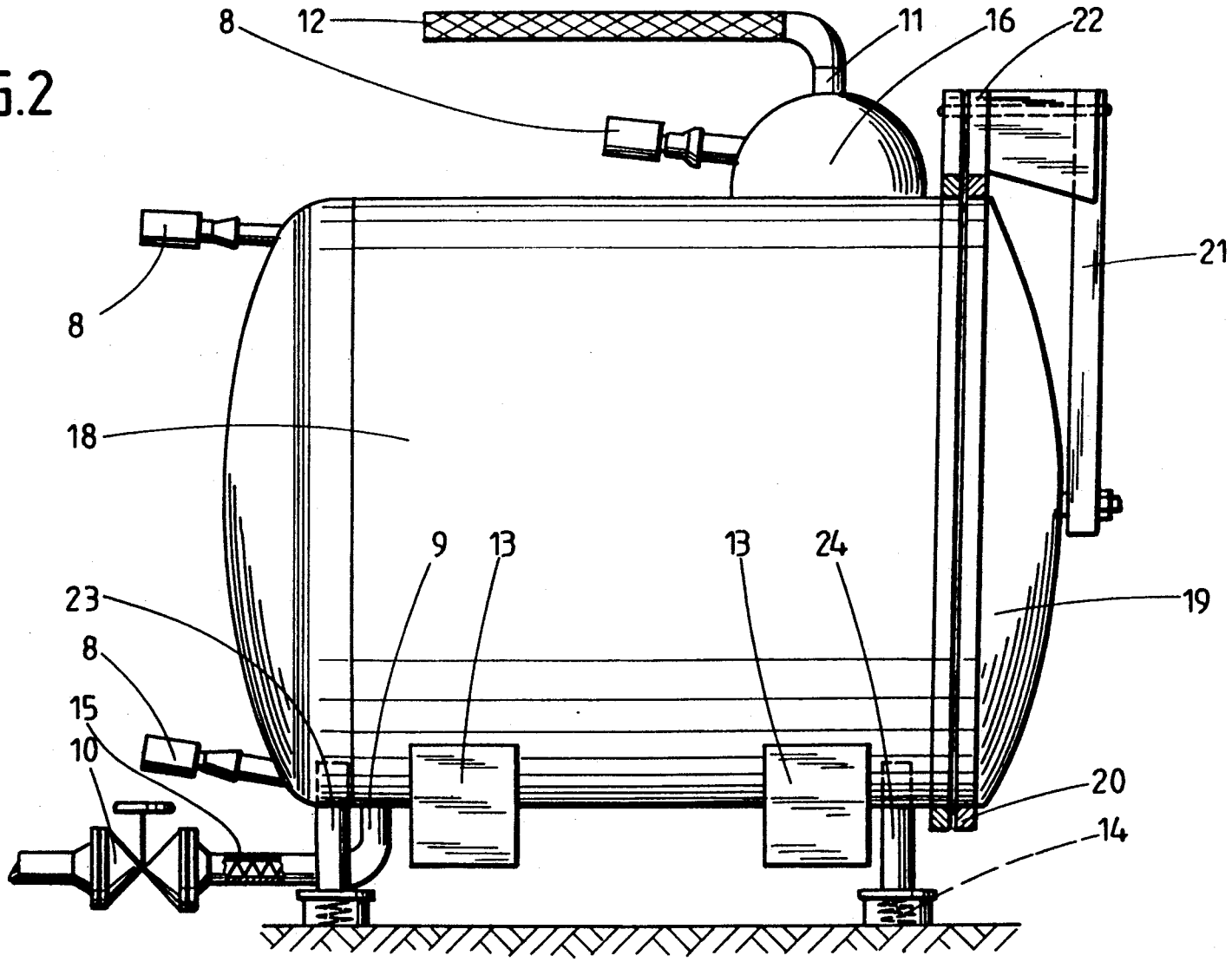
FIG. 2 shows a horizontal impregnation receptacle.

FIG. 2 shows a horizontal impregnation receptacle. This apparatus comprises an impregnation receptacle (18) which can be tightly sealed by means of a lid (19). A lid seal (20) is placed in position in a groove of the receptacle collar and serves as sealing means between the receptacle (18) and the lid (19). The receptacle (18) is provided with a bayonet catch (22) in which the lid (19) engages and which is locked by rotation.

The lid (19) is attached to a pivoting device (21) and can, therefore, be pivoted away laterally, such that the receptacle opening is clear for loading and unloading.

The receptacle (18) is supported on two pedestals (23 and 24) such that there is a slight falling-off inclination of a maximum of 5° relative to the receptacle floor.

A pipe connection for a filling pipeline (9) is provided in the receptacle floor. On the receptacle (18) , a dome (16) is provided on which is secured a pipe connection (11) for a connecting tube (12) to a vacuum pump. Three level-control devices (8) are provided in the receptacle bottom and on the dome for the control of the level of the impregnating liquid. One vibration generator (13) or a plurality of pairs of vibration generators (13) is/are attached to the side of the receptacle which subject the receptacle, together with its content, to vibrations. These vibration generators can be actuated mechanically or electromagnetically.

The receptacle is mounted on rocking elements (14), so that the vibrations generated are fully effective.

A spring bellows (15), which ensures a flexible connection to the pipe system, which is not shown, and to the supply tank, which is also not shown, is provided in the pipeline (9).

The process according to the invention is carried out in that the workpieces to be impregnated are loaded into the impregnation receptacle (1) or (18). The workpieces should be grease-free and dry. After sealing of the receptacle (1) or (18), respectively, using the lid (2) or (19), respectively, the receptacle is evacuated by means of a vacuum pump via the pipe connection (11). In doing so, care should be taken that a high vacuum is achieved in as short a time as possible. By opening the stop valve (10) in the filling pipeline (9), the impregnating agent is fed into the impregnation receptacle (1) or (18), respectively. Once the workpieces are submerged in the impregnating agent, the stop valve (10) is closed. Under the effect of the vacuum, the impregnating agent penetrates into the workpieces. Depending on the material of the workpieces to be impregnated and on the properties of the impregnating agent used, this operation may continue for between 5 minutes and a number of hours (e.g. in the case of the impregnation of wood).

The purpose of the invention is to reduce, drastically, this penetration time. It was thus found that, by vibration, the impregnation time could be reduced by half. In the case of a viscous impregnating agent, the penetration into the workpieces can further be promoted by additional impacting with compressed air or inert gas. Upon completion of the impregnating operation, the impregnating liquid is returned to the supply tank via the pipeline (9) and the stop valve (10).

This completes the actual impregnating operation. The subsequent treatment depends on the material and the impregnating agent which is used.

I claim:

1. A process for impregnating a solid workpiece of porous metal with a liquid impregnating agent, comprising the steps of:
   (a) placing the workpiece in an autoclave;
   (b) sealing the autoclave;
   (c) evacuating the sealed autoclave;
   (d) introducing sufficient impregnating agent into the sealed and evacuated autoclave to immerse the workpiece in the impregnating agent;
   (e) vibrating the sealed and evacuated autoclave until the process of impregnating the workpiece is complete; and
   (f) impacting the immersed workpiece with insert gas after the vibrating step.

2. A process according to claim 1, wherein the sealed and evacuated autoclave is vibrated at a particular frequency at which the sealed and evacuated autoclave resonates.

3. A process according to claim 1, further comprising the step of degassing the workpiece prior to placing the workpiece in the autoclave.

4. A process according to claim 1, further comprising the step of removing moisture from the workpiece prior to placing the workpiece in the autoclave.

5. A process for impregnating the hollow spaced in a porous solid metal article of manufacture with a liquid impregnating agent, comprising the steps of:
   (a) placing the article of manufacture in an autoclave;
   (b) sealing the autoclave;
   (c) evacuating the sealed autoclave;
   (d) introducing sufficient impregnating agent into the sealed and evacuated autoclave to immerse the article of manufacture in the impregnating agent;
   (e) vibrating the sealed and evacuated autoclave until the process of impregnating the hollow spaces in the article of manufacture is complete; and
   (f) impacting the immersed article of manufacture with insert gas after the vibrating step.

6. A process according to claim 5, wherein the sealed and evacuated autoclave is vibrated at a particular frequency at which the sealed and evacuated autoclave resonates.

7. A process according to claim 5, further comprising the step of degreasing the article of manufacture prior to placing the article of manufacture in the autoclave.

8. A process according to claim 5, further comprising the step of removing moisture from the article of manufacture prior to placing the article of manufacture in the autoclave.

* * * * *